US012680538B2

(12) United States Patent
Mochidzuki

(10) Patent No.: US 12,680,538 B2
(45) Date of Patent: Jul. 14, 2026

(54) CRYOPUMP

(71) Applicant: SUMITOMO HEAVY INDUSTRIES, LTD., Tokyo (JP)

(72) Inventor: Kenji Mochidzuki, Nishitokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 184 days.

(21) Appl. No.: 18/774,966

(22) Filed: Jul. 17, 2024

(65) Prior Publication Data

US 2024/0369052 A1 Nov. 7, 2024

Related U.S. Application Data

(63) Continuation of application No. PCT/JP2022/046490, filed on Dec. 16, 2022.

(30) Foreign Application Priority Data

Jan. 26, 2022 (JP) ..... 2022-010290

(51) Int. Cl.
*F04B 37/00* (2006.01)
*F04B 37/08* (2006.01)
*F04B 37/14* (2006.01)

(52) U.S. Cl.
CPC ..... *F04B 37/08* (2013.01); *F04B 37/14* (2013.01)

(58) Field of Classification Search
CPC . F04B 37/08; F04B 37/14; B01D 8/00; Y10S 417/901; F25B 9/10; F25B 9/14
See application file for complete search history.

(56) References Cited

U.S. PATENT DOCUMENTS

| | | | | |
|---|---|---|---|---|
| 4,449,373 | A | 5/1984 | Peterson et al. | |
| 9,046,091 | B2 | 6/2015 | Tanaka | |
| 9,266,038 | B2 * | 2/2016 | Syssoev | B01D 8/00 |
| 10,006,451 | B2 | 6/2018 | Oikawa | |
| 10,030,640 | B2 * | 7/2018 | Oikawa | F04B 37/085 |
| 12,140,129 | B2 * | 11/2024 | Takahashi | F04B 37/08 |
| 2016/0097380 | A1 | 4/2016 | Oikawa | |

FOREIGN PATENT DOCUMENTS

| | | | |
|---|---|---|---|
| JP | S5043208 | Y1 | 12/1975 |
| JP | S59218371 | A | 12/1984 |
| JP | 2004239239 | A | 8/2004 |
| JP | 2010084702 | A | 4/2010 |
| JP | 2016075218 | A | 5/2016 |
| JP | 2016191375 | A | 11/2016 |

* cited by examiner

*Primary Examiner* — Keith M Raymond
(74) *Attorney, Agent, or Firm* — HEA Law PLLC

(57) ABSTRACT

A cryopump includes: a cryopump container including a cryopump intake port; a radiation shield that is cooled to a first cooling temperature and extends from the cryopump intake port into the cryopump container; a cryopanel unit that is cooled to a second cooling temperature lower than the first cooling temperature and is disposed to be surrounded by the radiation shield in the cryopump container; and an intake port shield that is cooled to the first cooling temperature and is disposed at the cryopump intake port such that the cryopanel unit is not visible from an outside of the cryopump, in which the radiation shield includes a first gas inlet formed at a height between the intake port shield and the cryopanel unit.

9 Claims, 4 Drawing Sheets

CRYOPUMP

CROSS-REFERENCE TO RELATED APPLICATIONS

This is a bypass continuation of International PCT Application No. PCT/JP2022/046490, filed on Dec. 16, 2022, which claims priority to Japanese Patent Application No. 2022-010290, filed on Jan. 26, 2022, which are incorporated by reference herein in their entirety.

BACKGROUND

Technical Field

Certain embodiments of the present invention relate to a cryopump . . . .

Description of Related Art

A cryopump is a vacuum pump which captures gas molecules on a cryopanel cooled to a cryogenic temperature by condensation or adsorption to exhaust the gas molecules. The cryopump is generally used to realize a clean vacuum environment which is required for a semiconductor circuit manufacturing process or the like.

SUMMARY

According to an embodiment of the present invention, there is provided a cryopump including: a cryopump container including a cryopump intake port; a radiation shield that is cooled to a first cooling temperature and extends from the cryopump intake port into the cryopump container; a cryopanel unit that is cooled to a second cooling temperature lower than the first cooling temperature and is disposed to be surrounded by the radiation shield in the cryopump container; and an intake port shield that is cooled to the first cooling temperature and is disposed at the cryopump intake port such that the cryopanel unit is not visible from an outside of the cryopump, in which the radiation shield includes a first gas inlet formed at a height between the intake port shield and the cryopanel unit.

DETAILED DESCRIPTION

Figure 1:
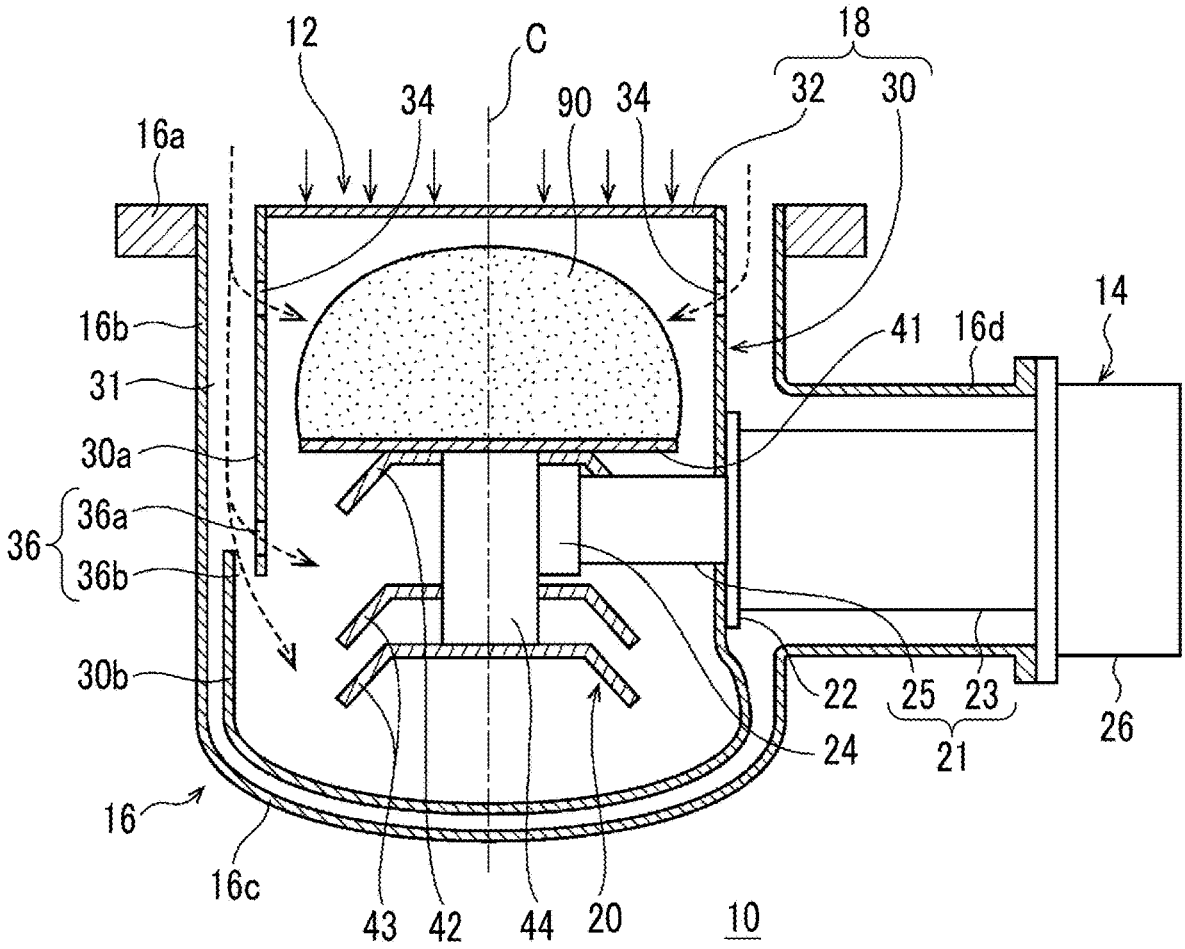
FIG. 1 is a side sectional view schematically showing a cryopump according to an embodiment.

A cryopump in which an inlet cryopanel having a large number of opening portions such as small holes is disposed at a cryopump intake port is known. For example, a target gas such as argon enters the cryopump from the outside of the cryopump through the opening portion of the inlet cryopanel and is captured by the cryopanel having a lower temperature than the inlet cryopanel disposed inside the cryopump. The captured target gas forms an ice mass on the low-temperature cryopanel.

However, the gas entering the cryopump is not limited only to the target gas. A low vapor pressure gas such as water vapor or radiant heat that has to be originally shielded by the inlet cryopanel can also somewhat enter the cryopump through the opening portion of the inlet cryopanel. Therefore, the ice mass on the low-temperature cryopanel is formed not only from the target gas but also from a mixed gas (for example, an argon gas and water vapor). Due to a difference in physical properties (for example, thermal conductivity or lattice constant) between different types of gases, the ice mass of the mixed gas tend to be more brittle and easier to break than the ice mass made of only the target gas. The radiant heat is incident into the ice mass to cause a temperature rise, and can promote the breaking of the ice mass. If the ice mass is broken and the ice piece falls and comes into contact with a higher-temperature portion such as the radiation shield, there is a concern that the ice piece may vaporize to generate a sudden pressure rise (also referred to as a microburst).

It is desirable to reduce the risk of the occurrence of a microburst in a cryopump.

Hereinafter, embodiments for carrying out the present invention will be described in detail with reference to the drawings. In the description and drawings, identical or equivalent components, members, and processing are denoted by the same reference numerals, and overlapping description is omitted as appropriate. The scale or shape of each part that is shown in the drawings is conveniently set for ease of description and is not limitedly interpreted unless otherwise specified. The embodiments are exemplary and do not limit the scope of the present invention in any way. All features or combinations thereof described in the embodiments are not essential to the invention.

Figure 2:
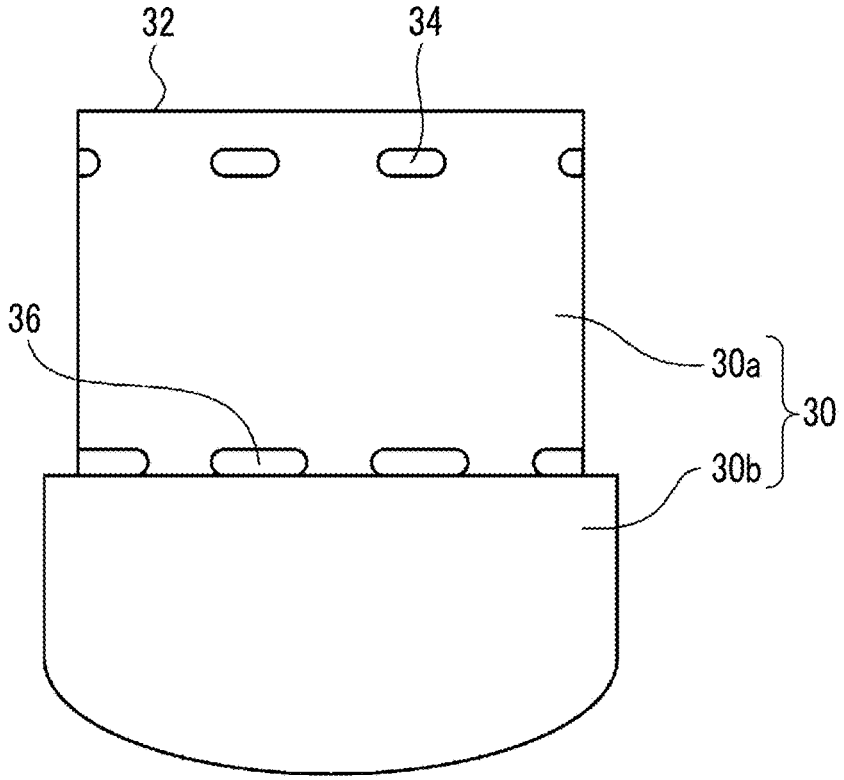
FIG. 2 is a side view schematically showing a radiation shield in the cryopump shown in FIG. 1.

FIG. 1 is a side sectional view schematically showing a cryopump 10 according to an embodiment. FIG. 2 is a side view schematically showing a radiation shield in the cryopump 10 shown in FIG. 1. FIG. 1 shows a cross section including a cryopump center axis (hereinafter, simply referred to as a center axis) C. For easy understanding, the center axis C is shown by a dash-dot line in FIG. 1.

The cryopump 10 is mounted to a vacuum chamber of, for example, an ion implanter, a sputtering apparatus, a vapor deposition apparatus, or other vacuum process equipment and is used to increase the degree of vacuum in the interior of the vacuum chamber to a level which is required for a desired vacuum process. The cryopump 10 includes a cryopump intake port (hereinafter also simply referred to as an "intake port") 12 for receiving gas to be exhausted from a vacuum chamber. The gas enters an internal space of the cryopump 10 through the intake port 12.

In the following, there is a case where the terms "axial direction" and "radial direction" are used in order to express the positional relationship between components of the cryopump 10 in an easily understandable manner. The axial direction of the cryopump 10 represents a direction passing through the intake port 12 (that is, a direction along the center axis C in the drawings), and the radial direction represents a direction along the intake port 12 (a direction perpendicular to the center axis C). For convenience, with respect to the axial direction, there is a case where the side relatively close to the intake port 12 is referred to as an "upper side" and the side relatively distant from the intake port 12 is referred to as a "lower side". That is, there is a case where the side relatively distance from the bottom of the cryopump 10 is referred to as an "upper side" and the side relatively close to the bottom of the cryopump 10 is referred to as a "lower side". With respect to the radial direction, there is a case where the side close to the center (in the drawing, the center axis C) of the intake port 12 is referred to as an "inner side" and the side close to the peripheral edge of the intake port 12 is referred to as an "outer side". Such expressions are not related to the disposition when the cryopump 10 is mounted to the vacuum chamber. For example, the cryopump 10 may be mounted to the vacuum chamber with the intake port 12 facing downward in the vertical direction.

Further, there is a case where a direction surrounding the axial direction is referred to as a "circumferential direction". The circumferential direction is a second direction along the intake port 12 and is a tangential direction orthogonal to the radial direction.

The cryopump 10 includes a cryocooler 14, a cryopump container 16, a first-stage cryopanel 18, and a cryopanel unit 20. The first-stage cryopanel 18 may be referred to as a high-temperature cryopanel part or a 100 K part. The cryopanel unit 20 is a second-stage cryopanel and may be referred to as a low-temperature cryopanel part or a 10 K part.

The cryocooler 14 is a cryocooler such as a Gifford McMahon type cryocooler (a so-called GM cryocooler), for example. The cryocooler 14 is a two-stage cryocooler, and includes a first cooling stage 22 and a second cooling stage 24. The cryocooler 14 is configured to cool the first cooling stage 22 to a first cooling temperature and cool the second cooling stage 24 to a second cooling temperature. The second cooling temperature is lower than the first cooling temperature. For example, the first cooling stage 22 is cooled to a temperature in a range of about 65 K to 120 K, preferably, in a range of 80 K to 100 K, and the second cooling stage 24 is cooled to a temperature in a range of about 10 K to 20 K. The first cooling stage 22 and the second cooling stage 24 may be referred to as a high-temperature cooling stage and a low-temperature cooling stage, respectively.

Further, the cryocooler 14 includes a cryocooler structure part 21 that structurally supports the second cooling stage 24 on the first cooling stage 22 and structurally supports the first cooling stage 22 on a room temperature part 26 of the cryocooler 14. Therefore, the cryocooler structure part 21 includes a first cylinder 23 and a second cylinder 25 that extend coaxially along the radial direction. The first cylinder 23 connects the room temperature part 26 of the cryocooler 14 to the first cooling stage 22. The second cylinder 25 connects the first cooling stage 22 to the second cooling stage 24. Typically, the first cooling stage 22 and the second cooling stage 24 are formed of a high thermal conductivity metal material such as copper (for example, pure copper), and the first cylinder 23 and the second cylinder 25 are formed of other metal materials such as stainless steel. The room temperature part 26, the first cylinder 23, the first cooling stage 22, the second cylinder 25, and the second cooling stage 24 are linearly arranged in a row in this order.

A first displacer and a second displacer (not shown) are reciprocally disposed in the interiors of the first cylinder 23 and the second cylinder 25, respectively. A first regenerator and a second regenerator (not shown) are respectively incorporated into the first displacer and the second displacer. Further, the room temperature part 26 has a drive mechanism (not shown) for reciprocating the first displacer and the second displacer. The drive mechanism includes a flow path switching mechanism that switches a flow path for a working gas (for example, helium) so as to periodically repeat the supply and discharge of the working gas to the and from interior of the cryocooler 14.

The cryocooler 14 is connected to a compressor (not shown) for the working gas. The cryocooler 14 cools the first cooling stage 22 and the second cooling stage 24 by expanding the working gas pressurized by the compressor in the interior thereof. The expanded working gas is recovered to the compressor and pressurized again. The cryocooler 14 generates cold by repeating a heat cycle including the supply and discharge of the working gas and the reciprocation of the first displacer and the second displacer in synchronization with the supply and discharge of the working gas.

The cryopump 10 which is shown in the drawing is a so-called horizontal cryopump. The horizontal cryopump is generally a cryopump in which the cryocooler 14 is disposed to intersect (usually, be orthogonal to) the center axis C of the cryopump 10. The present invention can similarly be applied to a so-called vertical cryopump. The vertical cryopump is a cryopump in which a cryocooler is disposed along the axial direction of the cryopump.

The cryopump container 16 is a vacuum container configured to maintain a vacuum airtightness of an internal space thereof. The cryocooler 14, the first-stage cryopanel 18, and the cryopanel unit 20 are accommodated in the cryopump container 16.

The intake port 12 is defined by the front end of the cryopump container 16. The cryopump container 16 includes an intake port flange 16*a* that extends outward in the radial direction from the front end thereof. The intake port flange 16*a* is provided over the entire circumference of the cryopump container 16. The cryopump 10 is mounted to a vacuum chamber of vacuum process equipment by using the intake port flange 16*a*.

In addition, the cryopump container 16 includes a container body portion 16*b* extending in the axial direction from the intake port flange 16*a*, a container bottom portion 16*c* that closes the container body portion 16*b* on a side opposite to the intake port 12, and a cryocooler accommodation cylinder 16*d* extending laterally between the intake port flange 16*a* and the container bottom portion 16*c*. The end portion of the cryocooler accommodation cylinder 16*d* on the side opposite to the container body portion 16*b* is mounted on the room temperature part 26 of the cryocooler 14, and thereby, the low temperature section (that is, the first cylinder 23, the first cooling stage 22, the second cylinder 25, and the second cooling stage 24) of the cryocooler 14 is disposed in the cryopump container 16 in a non-contact manner with the cryopump container 16. The first cylinder 23 is disposed inside the cryocooler accommodation cylinder 16*d*, and the first cooling stage 22, the second cylinder 25, and the second cooling stage 24 are disposed inside the container body portion 16*b*. The first-stage cryopanel 18 and the cryopanel unit 20 are also disposed in the container body portion 16*b*.

The first-stage cryopanel 18 includes a radiation shield 30 and an intake port shield 32, and surrounds the cryopanel unit 20. The first-stage cryopanel 18 provides a cryogenic surface for protecting the cryopanel unit 20 from the radiant heat from the outside of the cryopump 10 or the cryopump container 16. The first-stage cryopanel 18 is thermally coupled to the first cooling stage 22. Accordingly, the first-stage cryopanel 18 is cooled to the first cooling temperature. The first-stage cryopanel 18 has a gap between the first-stage cryopanel 18 and the cryopanel unit 20, and the first-stage cryopanel 18 is not in contact with the cryopanel unit 20. The first-stage cryopanel 18 is also not in contact with the cryopump container 16.

The radiation shield 30 is provided to protect the cryopanel unit 20 from the radiant heat of the cryopump container 16. The radiation shield 30 extends in a tubular shape (for example, a cylindrical shape) in the axial direction from the intake port 12 into the cryopump container 16. The radiation shield 30 is disposed between the cryopump container 16 and the cryopanel unit 20, and surrounds the cryopanel unit 20. The radiation shield 30 has a diameter slightly smaller than that of the cryopump container 16, and a shield outer gap 31 is formed between the radiation shield 30 and the cryopump container 16. Therefore, the radiation shield 30 is not in contact with the cryopump container 16.

The first cooling stage 22 of the cryocooler 14 is directly mounted on the side portion outer surface of the radiation shield 30. In this way, the radiation shield 30 is thermally coupled to the first cooling stage 22 to be cooled to the first cooling temperature. The radiation shield 30 may be mounted on the first cooling stage 22 via an appropriate heat transfer member. In addition, the second cooling stage 24 and the second cylinder 25 of the cryocooler 14 are inserted into the radiation shield 30 from the side portion of the radiation shield 30.

The radiation shield 30 includes a shield upper portion 30*a* that is disposed on the intake port 12 side with respect to the second cooling stage 24 of the cryocooler 14, and a shield lower portion 30*b* that is disposed on the container bottom portion 16*c* side with respect to the second cooling stage 24. The shield upper portion 30*a* is a cylinder in which both ends are open, and surrounds an upper portion of the cryopanel unit 20. The shield lower portion 30*b* is a bottomed cylinder in which an upper end thereof is open and a lower end is closed, and surrounds a lower portion of the cryopanel unit 20. The lower end of the shield upper portion 30*a* and the upper end of the shield lower portion 30*b* are located at substantially the same height. The diameter of the shield upper portion 30*a* is slightly smaller than the diameter of the shield lower portion 30*b*, and the shield outer gap 31 is made wider (compared to the outside of the shield lower portion 30*b*) on the outside of the shield upper portion 30*a*.

Although details will be described later, the radiation shield 30 has a first gas inlet 34 and a second gas inlet 36. The first gas inlet 34 is formed at a height between the intake port shield 32 and the cryopanel unit 20. The second gas inlet 36 is formed at a height between a portion of the cryopanel unit 20 closest to the intake port 12 and the container bottom portion 16*c*.

The intake port shield 32 is provided in the intake port 12 in order to protect the cryopanel unit 20 from radiant heat from an external heat source of the cryopump 10 (for example, a heat source in a vacuum chamber to which the cryopump 10 is mounted). The intake port shield 32 is thermally coupled to the first cooling stage 22 via the radiation shield 30, and is cooled to the first cooling temperature similarly to the radiation shield 30. Therefore, a gas (for example, moisture) that is condensed at the first cooling temperature is captured on the surface.

The intake port shield 32 is disposed at the intake port 12 such that the cryopanel unit 20 is not visible from the outside of the cryopump 10. In this embodiment, the intake port shield 32 completely closes the end portion opening of the radiation shield 30 on the intake port 12 side, that is, the upper end opening of the shield upper portion 30*a*. An opening portion is not provided in the intake port shield 32, and the radiant heat and the gas which are incident into the intake port shield 32 from the outside of the cryopump 10 are completely shielded by the intake port shield 32.

The intake port shield 32 is a disk that is disposed perpendicular to the center axis C so as to cross the intake port 12, has a diameter equal to the diameter of the shield upper portion 30*a*, and is joined to the upper end of the shield upper portion 30*a*. The intake port shield 32 may be mounted on a joint block (not shown) at the outer peripheral portion thereof. The joint block is a protrusion that protrudes inward in the radial direction at the upper end of the shield upper portion 30*a*, and the joint blocks are formed at equal intervals (for example, at 90° intervals) in the circumferential direction. The intake port shield 32 is fixed to the joint block by using a fastening member such as a bolt, or by using other appropriate methods such as welding.

The shield outer gap 31 is not blocked by the intake port shield 32. The intake port shield 32 may have a diameter larger than that of the radiation shield 30 as necessary, and thereby, a part of the shield outer gap 31 may be covered with the intake port shield 32.

The cryopanel unit 20 includes a plurality of cryopanels arranged in the axial direction. For convenience of description, a cryopanel closest to the intake port 12 among the cryopanels will be referred to as a top cryopanel 41. Each of the cryopanels is thermally coupled to the second cooling stage 24 and is cooled to the second cooling temperature lower than the first cooling temperature. The cryopanel unit 20 is disposed below the intake port shield 32 so as to be surrounded by the radiation shield 30 in the cryopump container 16. The cryopanel unit 20 is not in contact with the radiation shield 30 and the intake port shield 32.

The front surface of the top cryopanel 41 faces the back surface of the intake port shield 32, and no other cryopanel is provided between the top cryopanel 41 and the intake port shield 32. The top cryopanel 41 is disposed in the vicinity of substantially the middle in the axial direction in the container body portion 16*b* of the cryopump container 16. The center portion of the top cryopanel 41 may be directly mounted on the upper surface of the second cooling stage 24 of the cryocooler 14. An axial distance from the intake port shield 32 to the top cryopanel 41 may be in a range of, for example, 30% to 70% or 40% to 60% of an axial distance from the intake port shield 32 to the container bottom portion 16*c*. In this way, a relatively large space for accommodating a condensed layer 90 of an exhaust gas to be exhausted, which is condensed on the top cryopanel 41, is formed above the top cryopanel 41. As shown in the drawing, the condensed layer 90 can form a hemispherical ice mass.

The top cryopanel 41 is a disk-shaped member disposed perpendicular to the axial direction, and the center thereof is located on or in the vicinity of the center axis C of the cryopump 10. The top cryopanel 41 is flat over the entire surface and does not have an inclined surface. In order to condense more gas, the top cryopanel 41 may be relatively large, and the diameter of the top cryopanel 41 may be equal to or larger than, for example, 70% or 80% of the diameter of the intake port shield 32. In addition, the diameter of the top cryopanel 41 may be equal to or smaller than 98% or equal to or smaller than 90% of the diameter of the intake port shield 32. Accordingly, the top cryopanel 41 can be reliably brought into non-contact with the radiation shield 30. The axial projection area of the top cryopanel 41 may be an area in a range of 50% to 95%, preferably 73% to 90% of the area of the intake port shield 32.

In addition to the top cryopanel 41, one or a plurality of intermediate cryopanels 42, one or a plurality of lower cryopanels 43, and a connection cryopanel 44 are provided in the cryopanel unit 20. In this example, one intermediate cryopanel 42 and two lower cryopanels 43 are provided. The axial distance between the intermediate cryopanel 42 and the lower cryopanel 43 is wider than the axial distance between the lower cryopanels 43, and thus, a relatively wide condensed layer accommodation space is formed between the intermediate cryopanel 42 and the lower cryopanel 43.

Each of the intermediate cryopanel 42 and the lower cryopanel 43 has a frustum conical shape, and has a flat disk-shaped center portion and a radially outer downward inclined outer peripheral portion. The centers of the cryopanels are located on or in the vicinity of the center axis C of the cryopump 10. The intermediate cryopanel 42 is located below the top cryopanel 41 and above the second cooling stage 24, and the lower cryopanel 43 is located below the second cooling stage 24. The intermediate cryopanel 42 may be located at the same height as the second cooling stage 24 (between the upper surface and the lower surface of the second cooling stage 24). In addition, in this example, the diameters of both the intermediate cryopanel 42 and the lower cryopanel 43 are smaller than the diameter of the top cryopanel 41, and the diameter of the intermediate cryopanel 42 is smaller than the diameter of the lower cryopanel 43.

The connection cryopanel 44 extends from the second cooling stage 24 to the lower cryopanel 43 and thermally couples the lower cryopanel 43 to the second cooling stage 24. The connection cryopanel 44 may be a set of elongated plate-shaped members extending in the axial direction on both sides in the radial direction of the second cooling stage 24. An upper end of the connection cryopanel 44 is mounted on the second cooling stage 24, and a lower end is mounted on the lower cryopanel 43.

Each cryopanel configuring the cryopanel unit 20 is generally formed of a high thermal conductivity metal material such as copper (for example, pure copper), and the surface may be coated with a metal layer such as nickel in a case of being necessary. In addition, an adsorbent (for example, activated carbon) that captures a non-condensable gas (for example, hydrogen) by adsorption may be provided on the surface of at least a part of the cryopanel unit 20. For example, the adsorbent may be provided on the back surface of the top cryopanel 41, the intermediate cryopanel 42, and/or the lower cryopanel 43.

In addition, the specific configuration of the cryopanel unit 20 is not limited to the configuration described above. For example, an additional cryopanel may be provided between the top cryopanel 41 and the intake port shield 32, and the additional cryopanel may have a smaller diameter than the top cryopanel 41. The top cryopanel 41 may have a radially outer downward (or upward) inclined surface at an outer peripheral portion thereof. At least one cryopanel (for example, the lowermost cryopanel) of the intermediate cryopanel 42 and the lower cryopanel 43 may have a larger diameter than the top cryopanel 41. The intermediate cryopanel 42 and/or the lower cryopanel 43 may be a disk-shaped plate without an inclined surface, as in the top cryopanel 41. The shape of the cryopanel when viewed in the axial direction is not limited to a circular shape, and may be other shapes such as a rectangular shape and a polygonal shape.

The first gas inlet 34 is a plurality of opening portions formed in the shield upper portion 30*a*, and is located at an axial height between the intake port shield 32 and the top cryopanel 41. The first gas inlet 34 may be disposed relatively upward, and may be closer to the intake port shield 32 than the top cryopanel 41. The first gas inlet 34 may be formed at an upper end portion of the shield upper portion 30*a* and below an upper edge of the shield upper portion 30*a*.

As shown in FIG. 2, in this example, each opening portion that forms the first gas inlet 34 is a small hole elongated in the circumferential direction. The small holes are provided at equal intervals in the circumferential direction. The total area of the opening portions of the first gas inlet 34 may be equal to or smaller than, for example, 10% or 5% of the area of the intake port 12. The shape and disposition of the opening portion can be appropriately determined so as to realize desired exhaust performance (for example, exhaust velocity) of the cryopump 10.

The second gas inlet 36 is formed at an axial height between the top cryopanel 41 and the container bottom portion 16*c*, and in this example, at an axial height between the intermediate cryopanel 42 and the lower cryopanel 43. The second gas inlet 36 may be formed between the top cryopanel 41 and the intermediate cryopanel 42.

The second gas inlet 36 includes a plurality of opening portions 36*a* formed in the shield upper portion 30*a* (for example, a lower end portion of the shield upper portion 30*a*) and a shield gap 36*b* between the shield upper portion 30*a* and the shield lower portion 30*b*. The opening portion 36*a* is a small hole elongated in the circumferential direction, and the opening portions 36*a* are provided at equal intervals in the circumferential direction, as with the first gas inlet 34. In this example, the opening portion 36*a* is somewhat longer in the circumferential direction than the opening portion that forms the first gas inlet 34. The shield gap 36*b* is defined between the lower end portion of the shield upper portion 30*a* and the upper end portion of the shield lower portion 30*b*. The shape and disposition of the second gas inlet 36 can be appropriately determined so as to realize the desired exhaust performance (for example, the exhaust velocity) of the cryopump 10.

The operation of the cryopump 10 having the above configuration will be described below. When the cryopump 10 is operated, first, the interior of the vacuum chamber is roughed to about 1 Pa with another appropriate roughing pump before the operation. Thereafter, the cryopump 10 is operated. The first cooling stage 22 and the second cooling stage 24 are respectively cooled to the first cooling temperature and the second cooling temperature by driving of the cryocooler 14. Therefore, the first-stage cryopanel 18 and the cryopanel unit 20 thermally coupled to these cooling stages are also cooled to the first cooling temperature and the second cooling temperature, respectively.

The intake port shield 32 cools the gas that comes flying from the vacuum chamber toward the cryopump 10. A gas having a sufficiently low vapor pressure (for example, $10^{-8}$ Pa or less) at the first cooling temperature condenses on the surfaces of the intake port shield 32. This gas may be referred to as a type 1 gas. The type 1 gas is, for example, water vapor. In this way, the intake port shield 32 can exhaust the type 1 gas. In addition, the intake port shield 32 can shield radiant heat (indicated by a solid line arrow in FIG. 1) that is directed from the vacuum chamber to the cryopump 10.

A part of the gas enters the shield outer gap 31 from the periphery of the intake port shield 32. The type 1 gas is condensed on the surface of the shield upper portion 30*a* that defines the shield outer gap 31. A gas having a vapor pressure that is not sufficiently low at the first cooling temperature can enter the radiation shield 30 from the first gas inlet 34 or the second gas inlet 36 (indicated by a broken line arrow in FIG. 1).

The gas that has entered from the first gas inlet 34 is cooled by the top cryopanel 41. The gas that has entered from the second gas inlet 36 is cooled by the intermediate cryopanel 42 or the lower cryopanel 43. A gas having a sufficiently low vapor pressure (for example, $10^{-8}$ Pa or lower) at the second cooling temperature condenses on the surfaces of these cryopanels. This gas may be referred to as a type 2 gas. The type 2 gas is, for example, argon (Ar). In this way, the cryopanel unit 20 can exhaust the type 2 gas.

A gas in which vapor pressure is not sufficiently low at the second cooling temperature is adsorbed by the adsorbent on the cryopanel unit 20. This gas may be referred to as a type 3 gas. The type 3 gas is, for example, hydrogen ($H_2$). In this way, the cryopanel unit 20 can exhaust the type 3 gas. Therefore, the cryopump 10 can exhaust various gases by condensation or adsorption and can make the degree of vacuum of the vacuum chamber reach a desired level.

Figure 3:
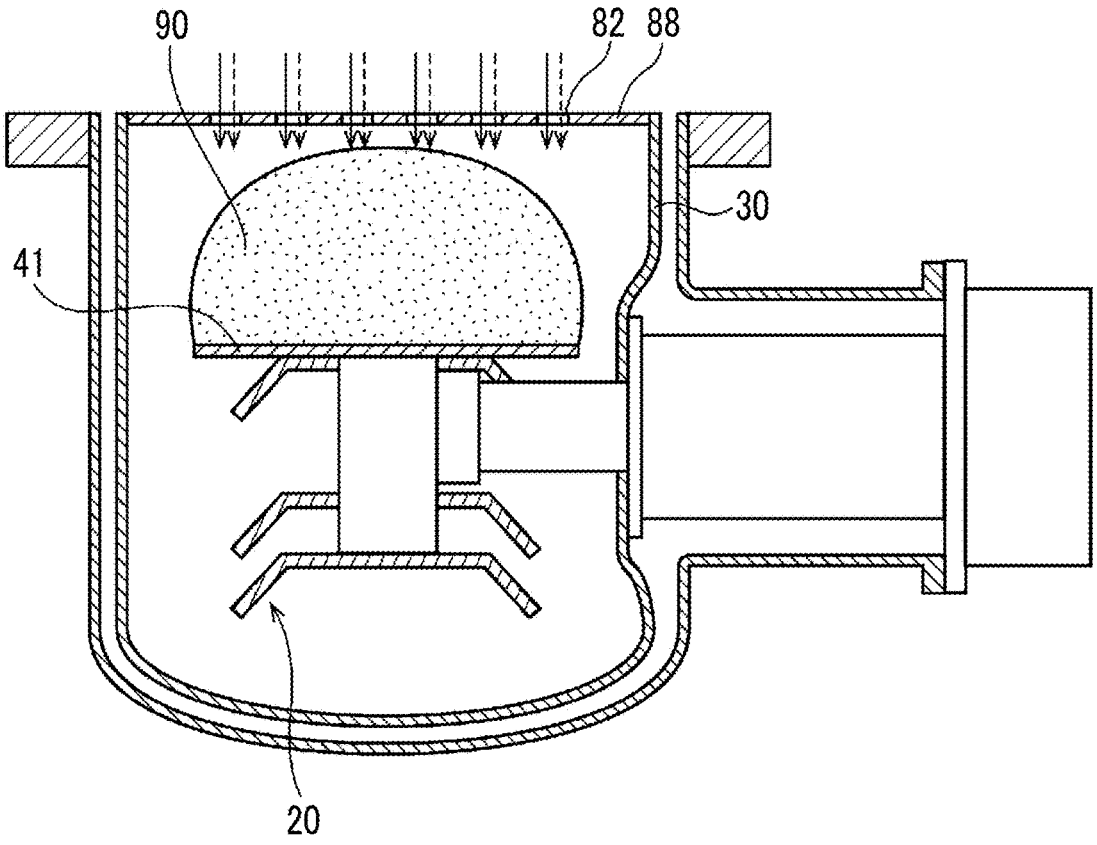
FIG. 3 is a side sectional view schematically showing a cryopump according to a comparative example.

FIG. 3 is a side sectional view schematically showing a cryopump according to a comparative example. In this cryopump, an inlet cryopanel 80 having a large number of opening portions 82 is mounted at the upper end opening of the radiation shield 30. The opening portions 82 are formed in the center portion of the inlet cryopanel 80. The radiation shield 30 is not provided with an opening portion for taking in a gas.

In this comparative example, the radiant heat enters the radiation shield 30 through the opening portions 82 of the inlet cryopanel 80 (indicated by a solid line arrow in FIG. 3). Since the opening portions 82 face the condensed layer 90 formed on the top cryopanel 41 of the cryopanel unit 20, the radiant heat is incident from the opening portions 82 to the surface of the condensed layer 90 and can raise the temperature of the condensed layer 90. In addition, a mixed gas of the type 1 gas and the type 2 gas (for example, a mixed gas of water vapor and an argon gas) that are not condensed on the surface of the inlet cryopanel 80 also enters the radiation shield 30 through the opening portions 82 (indicated by a broken line arrow in FIG. 3). Therefore, the condensed layer 90 can contain the type 1 gas and the type 2 gas.

The ice mass of the mixed gas tends to be more brittle and easier to break than the ice mass made of only one type of gas, due to a difference in physical properties (for example, thermal conductivity and lattice constant) between different types of gases. For example, the ice mass of the mixed gas of water vapor and an argon gas is more likely to be broken than the ice mass of the argon gas. The temperature rise of the surface due to the radiant heat incident into the ice mass can also promote the breaking of the ice mass. In a case where the ice mass is broken and the ice piece falls and comes into contact with the radiation shield 30, the ice piece rapidly vaporizes. In this way, a sudden pressure rise (also referred to as a microburst) may occur in the cryopump 10. This is undesirable because this may adversely affect the exhaust performance of the cryopump 10.

According to the cryopump 10 of the embodiment, the type 1 gas is basically captured on the intake port shield 32. Most of the type 1 gas that has entered the shield outer gap 31 without being captured is also captured by the side surface of the radiation shield 30 before reaching the first gas inlet 34 or the second gas inlet 36. Therefore, it can be expected that the type 1 gas hardly enters the radiation shield 30 and hardly mixes with the condensed layer 90. The type 2 gas and the type 3 gas can be accepted in the radiation shield 30 from the first gas inlet 34 or the second gas inlet 36. In addition, since the intake port shield 32 is disposed such that the cryopanel unit 20 is not visible from the outside of the cryopump 10, the incidence of the radiant heat on the cryopanel unit 20 from the outside of the cryopump 10 can be shielded by the intake port shield 32. Therefore, the temperature rise of the condensed layer 90 is also suppressed. In particular, in the present embodiment, since the upper end opening of the radiation shield 30 is completely closed by the intake port shield 32, the entry of the type 1 gas and the radiant heat can be effectively hindered compared to the comparative example. Therefore, according to the cryopump 10 of the embodiment, it is possible to reduce the risk of the occurrence of a microburst in the cryopump 10.

The present invention has been described above based on the examples. It will be understood by those skilled in the art that the present invention is not limited to the above embodiments, various design changes can be made, various modification examples are possible, and such modification examples are also within the scope of the present invention. Various features described in relation to an embodiment are also applicable to other embodiments. New embodiments resulting from combinations have the effect of each of embodiments which are combined.

In the embodiment described above, the radiation shield 30 has a divided structure having the shield upper portion 30*a* and the shield lower portion 30*b*. However, the radiation shield 30 may be a single component extending from the intake port 12 to the container bottom portion 16*c*, and the first gas inlet 34 and the second gas inlet 36 may be formed in such a single component.

Figure 4A:
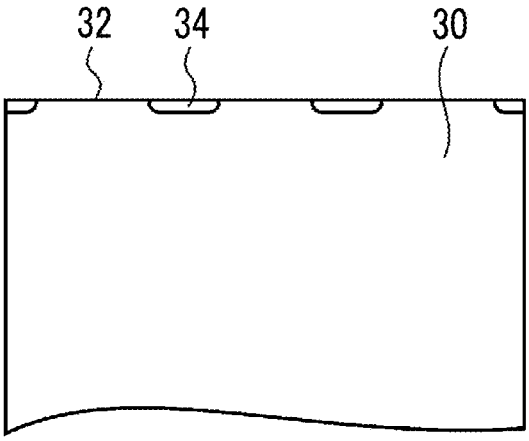
FIGS. 4A and 4B are side views schematically showing other examples of the radiation shield and an intake port shield which can be applicable to the cryopump shown in FIG. 1.
Figure 4B:
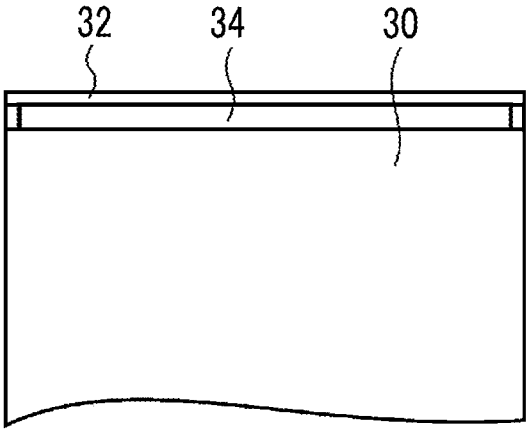
Figure 4C:
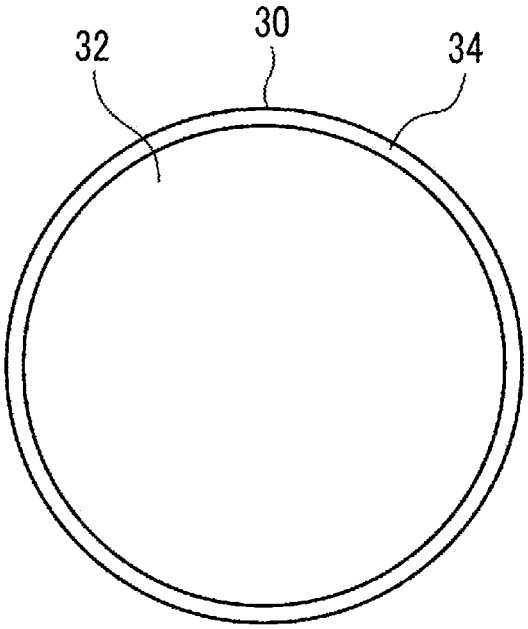
FIG. 4C is a top view schematically showing another example of the radiation shield and the intake port shield which can be applicable to the cryopump shown in FIG. 1.

In the embodiment described above, the first gas inlet 34 is provided in the radiation shield 30. However, the first gas inlet 34 may be provided between the radiation shield 30 and the intake port shield 32. For example, as shown in FIG. 4A, the first gas inlet 34 may be a cutout portion formed in the upper edge of the radiation shield 30. Alternatively, as shown in FIG. 4B, the intake port shield 32 may be disposed axially upward from the upper edge of the radiation shield 30 with a gap therebetween. As shown in FIG. 4C, the intake port shield 32 may be disposed radially inward from the upper edge of the radiation shield 30 with a gap (that is, the first gas inlet 34) therebetween.

Figure 5:
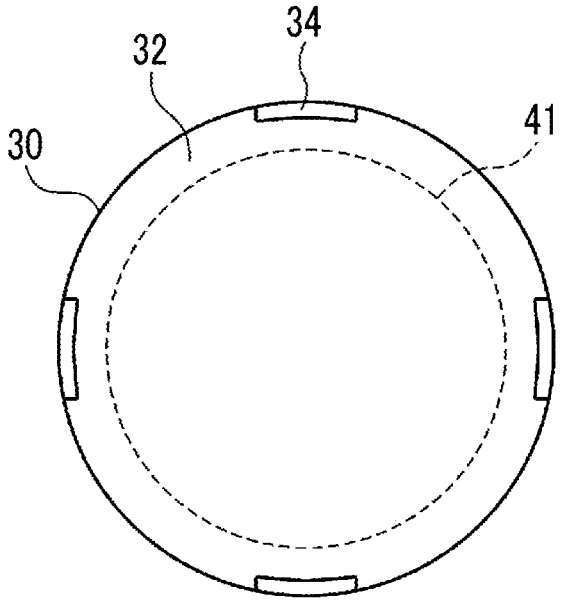
FIG. 5 is a top view schematically showing another example of the radiation shield and the intake port shield which can be applicable to the cryopump shown in FIG. 1.

In the embodiment described above, the intake port shield 32 completely closes the upper end opening of the radiation shield 30. However, an opening portion serving as the first gas inlet 34 may be formed in the intake port shield 32. In this case, in order to prevent the radiant heat from being directly incident into the cryopanel unit 20 through the opening portion of the intake port shield 32, the opening portion of the intake port shield 32 may be disposed on the intake port shield 32 such that the cryopanel unit 20 is not visible from the outside of the cryopump 10. As shown in FIG. 5, the opening portion (that is, the first gas inlet 34) of the intake port shield 32 may be provided on a radial outer side with respect to the cryopanel (for example, the top cryopanel 41) having the maximum diameter in the cryopanel unit 20, for example. An opening portion serving as the first gas inlet 34 is not provided on a radial inner side with respect to the cryopanel (for example, the top cryopanel 41) having the maximum diameter in the cryopanel unit 20.

The present invention has been described above based on the examples. It will be understood by those skilled in the art that the present invention is not limited to the above embodiments, various design changes can be made, various modification examples are possible, and such modification examples are also within the scope of the present invention.

The present invention can be used in the field of cryopumps.

It should be understood that the invention is not limited to the above-described embodiment, but may be modified into various forms on the basis of the spirit of the invention. Additionally, the modifications are included in the scope of the invention.

What is claimed is:

1. A cryopump comprising:

a cryopump container including a cryopump intake port;

a radiation shield that is cooled to a first cooling temperature and extends from the cryopump intake port into the cryopump container;

a cryopanel unit that is cooled to a second cooling temperature lower than the first cooling temperature and is disposed to be surrounded by the radiation shield in the cryopump container; and an intake port shield that is cooled to the first cooling temperature and is disposed at the cryopump intake port such that the cryopanel unit is not visible from outside of the cryopump, wherein the radiation shield includes a first gas inlet formed at a height between the intake port shield and the cryopanel unit, the cryopump container includes a container bottom portion opposite to the cryopump intake port, the cryopanel unit includes a plurality of cryopanels arranged in an axial direction of the cryopump from the cryopump intake port toward the container bottom portion, the plurality of cryopanels include a top cryopanel that is disposed closest to the cryopump intake port in the axial direction of the cryopump to face a back surface of the intake port shield, the intake port shield is coupled to the radiation shield to completely close an end portion opening of the radiation shield on a cryopump intake port side, and the intake port shield does not have any gas inlet opening.

2. The cryopump according to claim 1, wherein the first gas inlet is located at an axial height between the intake port shield and the top cryopanel.

3. The cryopump according to claim 1, wherein an axial distance from the intake port shield to the top cryopanel is in a range of 30% to 70% of an axial distance from the intake port shield to the container bottom portion.

4. The cryopump according to claim 1, wherein there is no cryopanel between the top cryopanel and the intake port shield.

5. The cryopump according to claim 1, wherein the first gas inlet includes a plurality of opening portions formed in an upper end portion of the radiation shield adjacent to the cryopump intake port.

6. The cryopump according to claim 1, wherein a total area of the first gas inlet is equal to or smaller than 10% of an area of the cryopump intake port.

7. The cryopump according to claim 1, wherein a diameter of the top cryopanel is equal to or larger than 80% of a diameter of the intake port shield.

8. The cryopump according to claim 1, wherein the radiation shield includes a second gas inlet located at an axial height between the top cryopanel and the container bottom portion.

9. The cryopump according to claim 8, wherein the radiation shield includes a shield upper portion that is disposed on a cryopump intake port side and a shield lower portion that is disposed on a container bottom portion side, the shield upper portion and the shield lower portion are disposed with a shield gap interposed therebetween, and the second gas inlet includes a plurality of opening portions and the shield gap, the opening portions formed at a lower end portion of the shield upper portion.

* * * * *